US006776286B2

(12) United States Patent
Bougamont et al.

(10) Patent No.: US 6,776,286 B2
(45) Date of Patent: Aug. 17, 2004

(54) SYSTEM FOR PRESERVING A LIQUID SUBSTANCE IN A FLEXIBLE CONTAINER

(75) Inventors: Jean-Louis Bougamont, Eu (FR); Pascal Hennemann, Eu (FR)

(73) Assignee: Rexam Sofab, Le Treport (FR)

( * ) Notice: Subject to any disclaimer, the term of this patent is extended or adjusted under 35 U.S.C. 154(b) by 0 days.

(21) Appl. No.: 10/098,512

(22) Filed: Mar. 18, 2002

(65) Prior Publication Data

US 2002/0096449 A1 Jul. 25, 2002

Related U.S. Application Data

(63) Continuation of application No. 09/509,527, filed as application No. PCT/FR98/02195 on Oct. 13, 1998, now Pat. No. 6,405,868.

(30) Foreign Application Priority Data

Oct. 16, 1997 (FR) ..... 97 12961

(51) Int. Cl.[7] ..... B65D 73/00
(52) U.S. Cl. ..... 206/484; 206/205; 206/438
(58) Field of Search ..... 206/205, 324.4, 206/484, 438, 525, 581

(56) References Cited

U.S. PATENT DOCUMENTS

| | | | | |
|---|---|---|---|---|
| 2,613,487 A | | 10/1952 | Vaughn | |
| 3,860,348 A | | 1/1975 | Doyle | |
| 3,881,634 A | | 5/1975 | Thrun | |
| 4,179,027 A | | 12/1979 | Weisberg | |
| 4,401,213 A | | 8/1983 | Lerner | |
| 4,430,013 A | | 2/1984 | Kaufman | |
| 4,727,705 A | | 3/1988 | Zahka | |
| 4,963,045 A | | 10/1990 | Willcoz | |
| 4,967,903 A | | 11/1990 | Kettle | |
| 5,014,869 A | | 5/1991 | Hammond | |
| 5,111,934 A | * | 5/1992 | Morin | 206/229 |
| 5,142,010 A | * | 8/1992 | Olstein | 526/248 |
| 5,451,369 A | | 9/1995 | Daeschel | |
| 5,541,233 A | * | 7/1996 | Roenigk | 521/54 |
| 5,811,471 A | * | 9/1998 | Shanbrom | 521/141 |
| 6,131,731 A | * | 10/2000 | Wooley | 206/207 |
| 6,270,754 B1 | * | 8/2001 | Zhou et al. | 424/78.08 |
| 6,299,520 B1 | * | 10/2001 | Cheyne, III | 451/532 |

FOREIGN PATENT DOCUMENTS

| | | |
|---|---|---|
| DE | 28 30 977 A | 1/1980 |
| WO | WO 94 26622 A | 11/1994 |
| WO | WO 97 10160 A | 3/1997 |

* cited by examiner

*Primary Examiner*—Shian T. Luong
(74) *Attorney, Agent, or Firm*—Bacon & Thomas

(57) ABSTRACT

A system for conserving a liquid substance (L) in a flexible receptacle (1), the substance being liable to be degraded and/or contaminated on contact with ambient air. The system includes a solid insert (3) whose outer envelope substantially matches the inside shape of the receptacle (1) in which the insert is immersed at least in part. The insert has bactericidal and/or chemical, especially antioxidant, activity and provides protective treatment by making contact with substance (L) over a large interchange area.

12 Claims, 3 Drawing Sheets

SYSTEM FOR PRESERVING A LIQUID SUBSTANCE IN A FLEXIBLE CONTAINER

The present invention relates to a system for conserving a liquid substance in a flexible receptacle.

More precisely, the invention relates to a substance that is liable to degrade chemically and/or become bacteriologically contaminated on contact with ambient air. Such substances are to be found in particular in the fields of food and of pharmaceuticals.

Until now, such substances have been protected by including preservative agents therewith, which agents are generally soluble and are therefore absorbed by the consumer at the same time as said substance.

Unfortunately, such preservatives can have harmful effects on the organism, and for example they can lead to metabolic troubles.

In addition, associating a plurality of different soluble agents can lead to chemical interactions of a kind that can spoil the liquid substance (deactivate it, discolor it, . . . ) or else neutralize or attenuate the effects of the agents because of mutual incompatibilities.

An object of the present invention is to solve those technical problem in satisfactory manner.

According to the invention, this object is achieved by means of a system for conserving a liquid substance in a flexible receptacle, said substance being liable to be degraded and/or contaminated on contact with ambient air, the system being characterized in that it comprises a solid insert whose outer envelope substantially matches the inside shape of the receptacle in which the insert is immersed at least in part, said insert providing protective treatment by making contact with said substance over a large interchange area.

In a first embodiment, the insert is elastically deformable and its volume is substantially equal to the inside volume of the receptacle.

In a second embodiment, the insert is rigid, and its volume is determined as a function of the inside volume of the receptacle in such a manner as to limit compression of the receptacle and thus limit the size of the dose of substance that can be dispensed.

According to an advantageous characteristic, the geometry of the insert is determined so as to leave at least one preferred zone for deformation of the wall of the receptacle.

In a specific variant, said preferred zone for deformation is constituted by a peripheral groove formed substantially halfway along the insert and of dimensions that are appropriate for being held in the hand.

According to another characteristic, the insert is made out of a material that, on coming into contact with the substance, presents action that is bactericidal and/or chemical, in particular antioxidant.

According to yet another characteristic, said insert is made of a porous or spongy material capable of being impregnated by the liquid substance.

Preferably, the porosity of the material constituting the insert lies in the range 40% to 60%, and its pore diameter lies in the range 5 $\mu$m to 60 $\mu$m.

In a first variant, said insert is made as a single piece.

In another variant, said insert is made in the form of a filling of a plurality of pieces.

Preferably, the outer envelope of the insert substantially matches the inside shape of the receptacle.

The system of the invention makes it possible to preserve the intrinsic qualities and properties of the liquid substance since there is no need to mix it with preservative agents.

The insert performs its protective treatment by coming into contact with the liquid substance. The large volume of the insert, and in particular its internal cellular structure, makes it possible to increase the interchange surface area, and consequently to increase the effectiveness and the lifetime of the protective treatment.

In addition, the insert of the invention participates in measuring out the liquid substance by forming an internal stiffener element whose capacity for deformation is less than that of the wall of the flexible receptacle.

The invention will be better understood on reading the following description and the accompanying drawings, in which.

The system shown in the figures is designed to conserve a liquid substance L contained in a flexible receptacle 1 fitted with a dispenser member such as an endpiece or a nozzle 2.

The substance L is more particularly a substance that, on coming into contact with ambient air, is liable to spoil or to be chemically degraded (e.g. by oxidation) and/or to be contaminated bacteriologically.

By way of example, such substances can be pharmaceuticals.

To preserve such substances from any spoiling, degradation, or contamination, the invention provides for placing an insert 3 inside the receptacle to perform protective treatment.

The insert 3 is a solid element that is immersed at least in part in the substance, inside the receptacle 1.

The insert 3 is preferably made using a material that has cavities or cells of small dimensions into which the substance L penetrates.

The insert 3 is then impregnated with the substance, which means that each of its internal cavities contains a fraction thereof. The total surface area of the walls of the cavities in contact with the liquid substance L is thus vast.

For this purpose, the porosity of the insert 3 is preferably determined so that its empty volume fraction lies in the range 40% to 60% and its pore diameter lies in the range 5 $\mu$m to 60 $\mu$m.

The matter constituting the insert 3 possess bactericidal and/or chemical properties, in particular anti-oxidizing properties, that act on making contact with the substance L. It is thus possible to provide for the material to act as a reagent or as a modifying agent with respect to the liquid substance L for a determined purpose.

The insert 3 can be made as a single piece of porous, spongy, or cellular material, as shown in the figures, or as a plurality of pieces in the form of a filling using beads, plates, granules, cloth, etc.

Figure 1A:
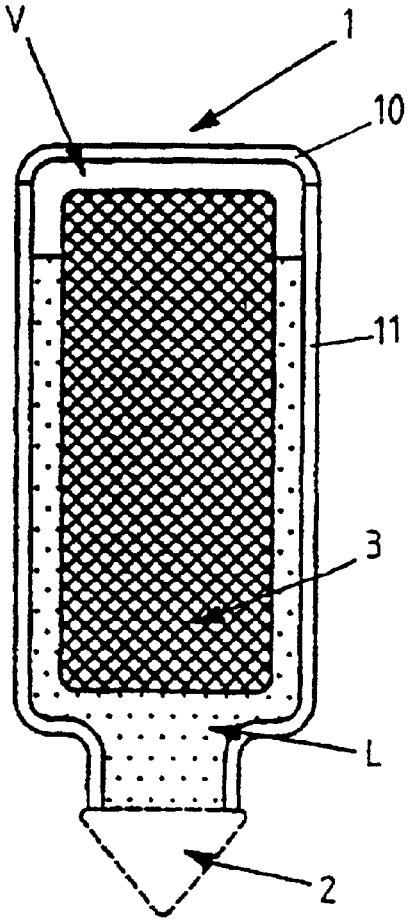
FIGS. 1A and 1B are diagrammatic section views of a first embodiment of the invention respectively in its rest position and in its dispensing position.
Figure 1B:
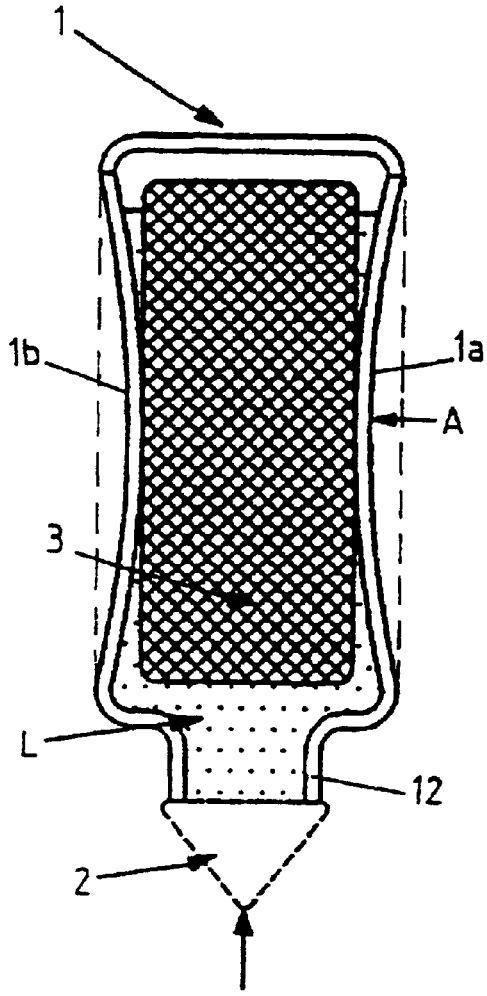

In the embodiment of FIGS. 1A and 1B, the insert 3 is rigid and its volume is previously determined as a function of the inside volume of the receptacle so as to limit elastic deformation thereof.

More precisely, compressing the size of the flexible receptacle 1 brings the internal side surfaces of its walls 1*a*, 1*b* into abutment against the rigid insert 3. The outer envelope of the insert 3 is of a shape that substantially matches the inside shape of the receptacle 1. The amplitude A of possible deformation corresponds to a determined volume of substance L being expelled, and thus constitutes a unit dose.

When the walls 1*a*, 1*b* of the receptacle are released, a volume V of air is sucked into the receptacle which then returns to its initial shape.

The receptacle 1 is preferably made in two parts, e.g. an end wall 10 that is designed to be assembled to a cylinder 11 after the insert 3 has been inserted therein.

The insert 3 is free to move inside the receptacle, and in order to ensure that it does not impede delivery of the substance, provision is made to ensure that the insert 3 cannot block the neck 12 while the substance L is being dispensed with the nozzle pointing downwards.

By way of example, this disposition can be obtained by providing shoulders in the receptacle including lateral passages for the substance.

The porosity of the insert also gives it sufficient buoyancy to remain in suspension in the liquid L.

Figure 2A:
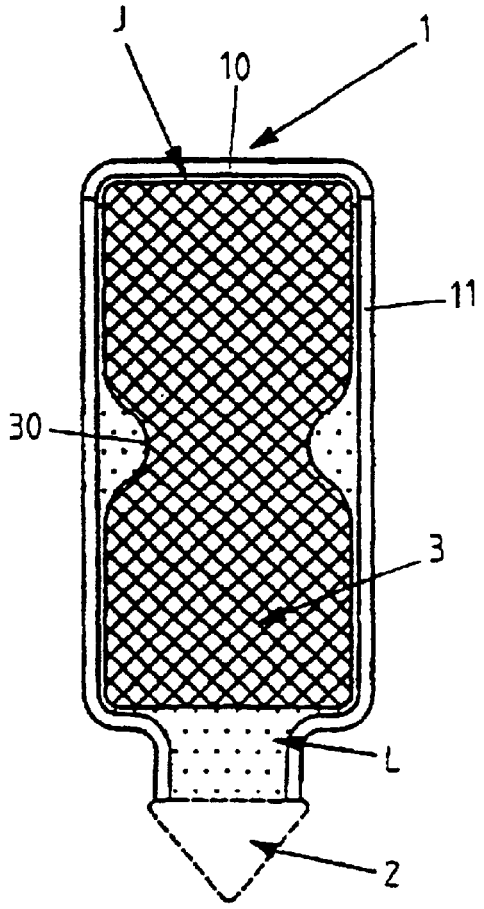
FIGS. 2A and 2B are diagrammatic section views of a second embodiment of the invention respectively in its rest position and in its dispensing position.
Figure 2B:
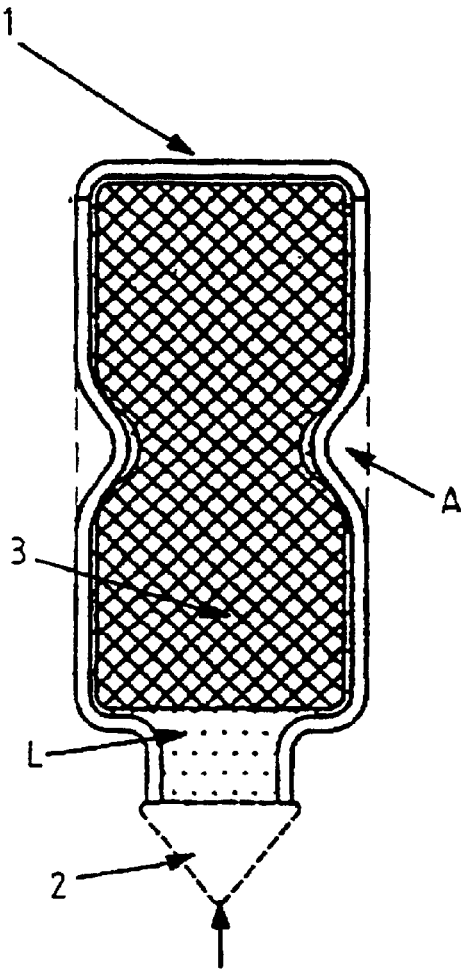

In the embodiment of FIGS. 2A and 2B, the insert 3 is still rigid, but its geometry is specifically selected to create at least one preferred zone for deformation of the wall of the receptacle 1.

In this case, this zone is constituted by a peripheral groove 30 formed substantially halfway along the insert 3.

The inside volume of the peripheral groove 30 correspond substantially to one dose of substance.

The dimensions of the envelope around the insert 3 are smaller than the inside dimensions of the receptacle 1, at least laterally, so as to leave clearance J between them.

Figure 3A:
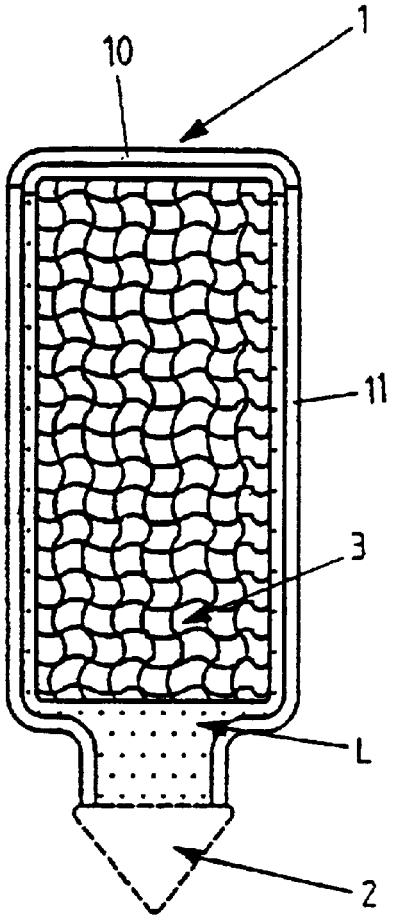
FIGS. 3A and 3B are diagrammatic section views of a third embodiment of the invention respectively in its rest position and in its dispensing position.
Figure 3B:
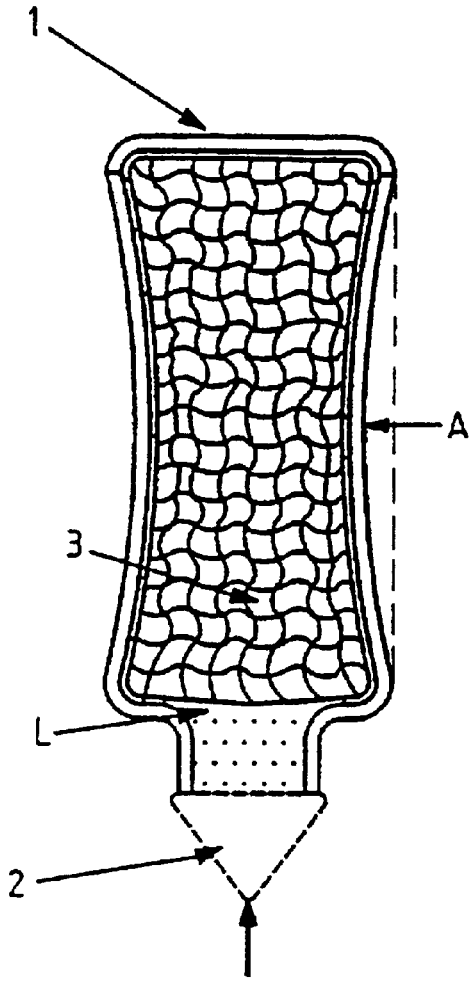

In the embodiment of FIGS. 3A and 3B, the insert 3 is elastically deformable.

Its volume is substantially equal to the inside volume of the flexible receptacle 1 such that the volume of residual air between the insert 3 and the wall of the receptacle is very small.

In contrast, a fraction of air is included in the cavities of the spongy material.

The material constituting the insert is spongy. Thus, when the side walls of the receptacle are compressed (FIG. 3B), the insert 3 is also compressed, thereby expelling a fraction of the liquid L from the internal cavities of the insert.

Releasing the receptacle causes an air fraction to be sucked in and absorbed by the spongy matter.

Under such circumstances, there is no limit on the deformation of the receptacle, so dosage needs to be estimated by the user.

What is claimed is:

1. A system for conserving a liquid substance (L) in a flexible receptacle (1), said substance being liable to degradation and/or contamination on contact with ambient air, the system being characterized in that it comprises a solid insert (3) and said liquid substance (L) within said receptacle (1) wherein said insert has an outer shape which substantially matches the inside shape of the receptacle (1), said insert being made of material having an anti-degradation and/or anti-contamination property whereby said insert protects said liquid from said degradation and/or said contamination upon making contact with said substance (L) over a large interchange area; and wherein the insert is free to move inside the receptacle.

2. A system according to claim 1, characterized in that the insert (3) is elastically deformable and has a volume which is substantially equal to the inside volume of the receptacle (1).

3. A system according to claim 1, characterized in that the insert (3) is rigid, and has a volume which is determined as a function of the inside volume of the receptacle (1) in such a manner as to limit compression of the receptacle and thus limit the size of the dose of substance (L) that can be dispensed.

4. A system according to claim 1, characterized in that the geometry of the insert (3) is determined so as to leave at least one preferred zone for deformation of the wall (1*a*, 1*b*) of the receptacle (1).

5. A system according to claim 4, characterized in that said preferred zone for deformation is constituted by a peripheral groove (30) formed substantially halfway along the insert (3) and of dimensions that are appropriate for being held in the hand.

6. A system according to claim 1, characterized in that the insert (3) is made out of a material that, on coming into contact with the substance (L), presents action that is bactericidal and/or chemical.

7. The system of claim 6 wherein said insert is made out of a material that, on coming into contact with the substance (L), presents an action that is chemical with the proviso that said chemical action is an antioxidant action.

8. A system according claim 1, characterized in that said insert (3) is made of a porous or spongy material capable of being impregnated by the liquid substance (L).

9. A system according to claim 8, characterized in that the porosity of the material constituting the insert lies in the range 40% to 60%, and its pore diameter lies in the range 5 $\mu$m to 60 $\mu$m.

10. A system according to claim 1, characterized in that said insert (3) is made as a single piece.

11. A system according to claim 1, characterized in that said insert (3) is made in the form of a filling of a plurality of pieces.

12. A system for conserving a liquid substance (L) in a flexible receptacle (1), said substance being liable to degradation and/or contamination on contact with ambient air, the system being characterized in that it comprises a solid insert (3) within said receptacle (1) wherein said insert has an outer shape which substantially matches the inside shape of the receptacle (1) said insert being made of material having an anti-degradation and/or anti-contamination property whereby said insert protects said liquid from said degradation and/or said contamination upon making contact with said substance (L) over a large interchange area; and wherein the insert is free to move inside the receptacle;

with the proviso that the insert (3) is rigid, and has a volume which is determined as a function of the inside volume of the receptacle (1) in such a manner as to limit compression of the receptacle and thus limit the size of the dose of substance (L) that can be dispensed.

* * * * *